US005490806A

United States Patent [19]

Spector

[11] Patent Number: 5,490,806

[45] Date of Patent: Feb. 13, 1996

[54] TOY HOOP

[76] Inventor: Donald Spector, 380 Mountain Rd., Union City, N.J. 07080

[21] Appl. No.: 287,925

[22] Filed: Aug. 9, 1994

[51] Int. Cl.[6] ..... A63H 18/00

[52] U.S. Cl. ..... 446/48; 446/236

[58] Field of Search ..... 446/48, 46, 47, 446/236, 487, 488; 244/153 A, 153 R

[56] References Cited

U.S. PATENT DOCUMENTS

| | | | |
|---|---|---|---|
| 4,241,533 | 12/1980 | Newsome | 446/46 |
| 4,279,097 | 7/1981 | Walker | 446/46 |
| 4,290,226 | 9/1981 | Stauffer | 446/46 |
| 4,709,928 | 12/1987 | Willingham | 446/46 |
| 4,832,652 | 5/1989 | Matsuyama | 446/46 |
| 4,944,707 | 7/1990 | Silvergate | 446/48 |
| 5,078,637 | 1/1992 | McFarland | 446/48 |
| 5,123,869 | 6/1992 | Schipmann | 446/46 |
| 5,261,846 | 11/1993 | Hanna | 446/46 |
| 5,358,440 | 10/1994 | Zheng | 446/48 |

FOREIGN PATENT DOCUMENTS

| | | | |
|---|---|---|---|
| 9013337 | 11/1990 | WIPO | 446/236 |

*Primary Examiner*—Robert A. Hafer
*Assistant Examiner*—Michael O'Neill
*Attorney, Agent, or Firm*—Michael Ebert

[57] ABSTRACT

A toy hoop that in a relatively small diameter is useable as a flying ring which when launched by a player then spins in the air, and in a larger diameter as a Hula-Hoop which whirls about the player's body. The hoop is composed of a planar annulus of non-stretchable, non-woven plastic sheeting having circular inner and outer peripheries, and a spring metal ring concentric with and joined to the outer periphery of the annulus whose inner periphery is free. In the flying toy mode of the hoop, the annulus functions as an air foil to impart aerodynamic properties to the toy. In the Hula-Hoop mode, the annulus functions as a protective soft inner liner. To reduce the hoop to a compact state, the ring is twisted 360 degrees to create an endless coil having three intermeshing convolutions whose diameter is about one third that of the untwisted ring.

5 Claims, 1 Drawing Sheet

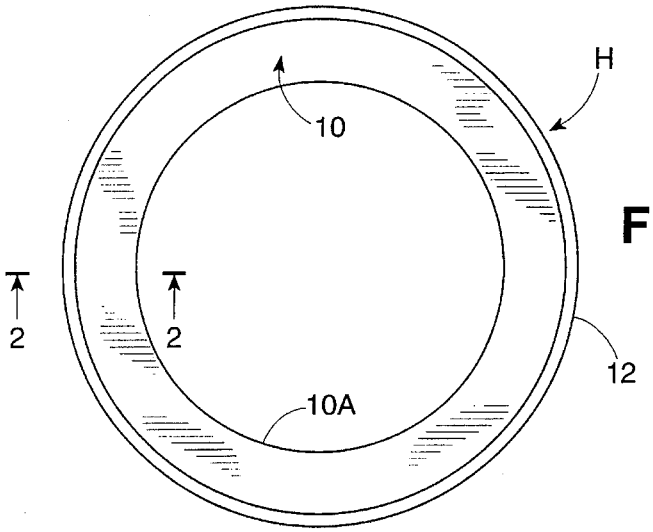
FIG. 1
FIG. 2
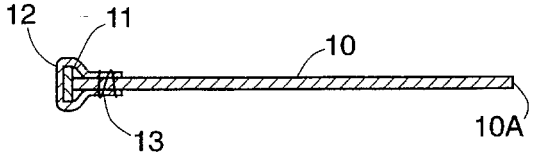
FIG. 3
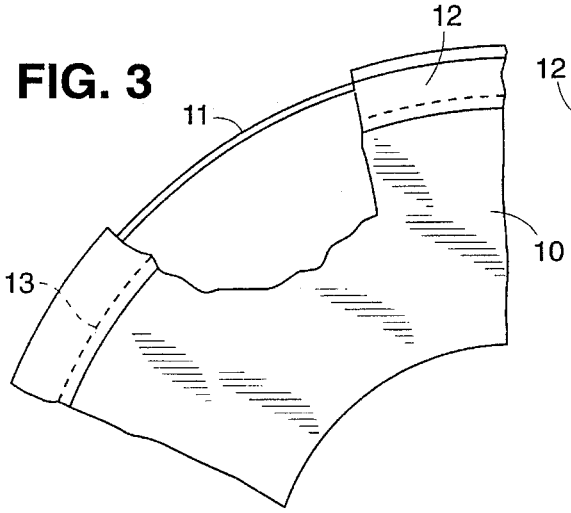
FIG. 4
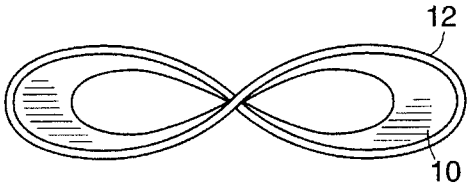
FIG. 5
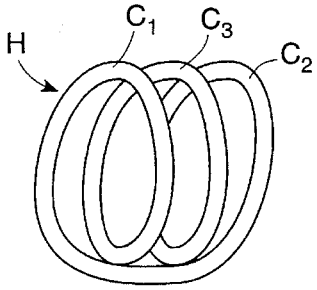
FIG. 6
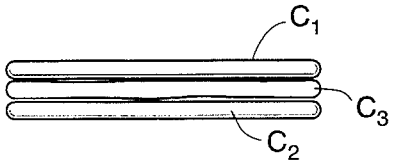

TOY HOOP

BACKGROUND OF INVENTION

1. Field of Invention

This invention relates generally to toy hoops, and more particularly to a toy hoop which depending on its diameter is useable as a flying toy which when launched by a player then spins in the air, or as a Hula-Hoop that whirls about the player's body.

2. Status of Prior Art

A FRISBEE toy is a flying disc in a saucer shape that can be thrown over relatively long distances. To launch a FRISBEE, a player grasps its edge and flexes his wrist inwardly, holding his forearm in a neutral position. The player then quickly extends his wrist and releases the disc, this action imparting a spin to the disc and propelling it through the air. Flying discs of the FRISBEE type are disclosed in U.S. Pat. Nos. 3,359,678 and 4,560,358.

Of greatest prior art interest is the U.S. Pat. No. 4,994,707 to Silverglate which discloses a ring-like flying toy having inner and outer circular boundary structures defining an annular space therebetween. This space is spanned by an annular air foil web that is joined to and tensed between the boundary structures. The boundary structures include a tubular plastic ring that is deformable. The annular web which functions as an air foil, is fabricated of a stretchable fabric that is air permeable and has an elastomeric memory.

Also a prior art interest is the conventional Hula-Hoop which is formed by a light weight plastic hoop of large diameter. This hoop is whirled about the body of a player by an oscillating movement of the hips.

SUMMARY OF INVENTION

The main object of this invention is to provide a toy hoop which depending on its diameter is useable as a flying toy that when launched by a player spins in the air, as a Hula-Hoop that whirls about the body of a player.

More specifically, an object of the invention is to provide a toy hoop of the above type that includes a planar annulus of non-stretchable, non-woven fabric sheeting, the annulus in the flying toy mode of the hoop functioning as an air foil and in the Hula-Hoop mode as a protective inner liner.

A significant feature of the invention is that the toy hoop in either mode is collapsible to create a compact endless coil that can be conveniently stored or carried.

Briefly stated, these objects are attained in a toy hoop that in a relatively small diameter is useable as a flying ring which when launched by a player then spins in the air, and in a larger diameter as a Hula-Hoop which whirls about the body of a player. The hoop is composed of a planar annulus of non-stretchable, non-woven plastic sheeting having circular inner and outer peripheries, and a spring metal ring concentric with and joined to the outer periphery of the annulus whose inner periphery is free. In the flying toy made of the hoop, the annulus functions as an air foil to impart aerodynamic properties to the toy. In the Hula-Hoop mode, the annulus functions as a protective soft inner liner. To reduce the hoop to a compact state, the ring is twisted 360 degrees to create an endless cord having three intermeshing convolutions whose diameter is about one third that of the untwisted ring.

BRIEF DESCRIPTION OF DRAWING

For a better understanding of the invention reference is made to the detailed description to follow which is to be read in conjunction with the accompanying drawings of which:

FIG. 1 illustrates, in plan view, a toy hoop in accordance with the invention which depending on its diameter is a flying ring or a Hula-Hoop;

FIG. 2 is a section taken in the plane indicated by line 2—2; the section being enlarged;

FIG. 3 is a cut away portion of the hoop which exposes the wire ring which is joined to the outer periphery of a fabric annulus;

FIG. 4 illustrates an intermediate step in collapsing the hoop;

FIG. 5 shows the coil which is formed when the hoop is fully collapsed; and

FIG. 6 shows the coil in a compressed state in condition for storage.

DESCRIPTION OF INVENTION

The Hoop

Referring now to FIGS. 1, 2 and 3, there is shown a hoop H in accordance with the invention which in a relatively small diameter similar to that of a conventional FRISBEE, is useable as a flying ring, and in a much larger diameter similar to that of a conventional Hula-Hoop, is useable as such. Thus the mode of operation depends on the diameter of the hoop.

Hoop H includes a planar annulus 10 formed of non-stretchable, non-woven fabric sheeting such as TYVEK, a well-known, non-woven fabric produced by DuPont. This non-woven fabric, though of high strength and difficult to tear, is soft and highly flexible, and impermeable to air. Non-woven fabric sheeting is formed from synthetic plastic such as Dacron, nylon or polypropylene fibers which are entangled to create a web, the fibers being bonded together at their intersections.

The outer circular periphery of annulus 10 is joined to and reinforced by a concentric spring metal ring 11 formed of a strip of phosphor bronze or other highly deformable spring metal in strip form. The characteristics of this metal are such that however the circular strip of spring metal is deformed by hand, the deformed ring, when released, will spring back to its normal circular shape.

Ring 11, as best seen in FIGS. 2 and 3 is joined to the outer periphery of the annulus by a fabric tape 12 which is wrapped about the ring and then sewn to the periphery of the annulus by stitching 13. Alternatively, a tape whose inner surface is coated with a pressure-sensitive adhesive may be used to join the ring to annulus 10.

The inner circular periphery of annulus 10 which has a soft edge is free, hence when pressure is applied thereto, the planar annulus is crushed inwardly.

When the diameter of the hoop is relatively small so that the hoop is then a flying ring toy capable of being manipulated by a player in the manner of a FRISBEE, the annulus then functions as an air foil to impart aerodynamic properties to the spinning hoop as it is propelled in the air. But unlike a FRISBEE, the flying ring may also be caught by grasping the inner periphery of the annulus.

When constructed in a diameter to function as a Hula-Hoop, then the hoop shown in the figure can be whirled about the body of a player. In this mode of operation, the soft fabric of annulus 10 of the hoop serves as a crushable inner liner to protect the body of the child or other player manipulating the hoop with his hips.

Thus the toy hoop structure functions either as a flying ring or as a Hula-Hoop, depending on its diameter. Because the non-woven sheeting has paper-like characteristics, it may be decoratively printed or colored by hand.

Collapsed Hoop

In order to reduce the hoop into a compact structure so that it may be conveniently stored or carried, the hoop is twisted into a coil having third intermeshing convolutions whose diameter is about one third that of the untwisted hoop. To bend, the hoop is grasped at its diametrically opposed sides, as indicated by the arrows in FIG. 4, and then twisted 360 degrees. FIG. 4 illustrates the intermediate state which exists at 180 degree of twist when the hoop assumes a figure-of-eight shape. As the twisting action continues, three convolutions $C_1$, $C_2$ and $C_3$ are formed, the three convolutions $C_3$ being interposed between the first and second convolutions $C_1$ and $C_2$ to create an endless coil. This is shown in FIG. 5 in which convolution $C_1$ leads into convolutions $C_2$, and convolution $C_2$ leads into convolution $C_3$ which leads back into convolution $C_1$.

The convolutions of the endless coil as shown in FIG. 6 are compressed and held together by a tie string or other means (not spun), so that in this highly compact state, the hoop may be carried in a pocket or stored in a box. Or the hoop coil may be inserted in a tight pouch which prevents it from expanding.

One cannot achieve the same result with a tubular plastic ring as in the Silverglade patent, for plastic, however flexible, does not have the high degree of deformability of a spring metal ring such as one made of a strip of clock spring steel. Because the annulus to which the ring is joined is of soft fabric material, it is crushed when the ring is twisted and does not interfere with the twisting action. However, when the ring resumes its normal circular shape, the annulus again become planar.

While there has been shown and disclosed preferred embodiments of the invention, it will be appreciated that many changes my be made therein without departing from the spirit of the invention. Thus instead of non-woven fabric sheeting for the annulus one may use a sheeting formed of a laminate of paper and synthetic plastic film of high tensile strength.

I claim:

1. A toy hoop which in a relatively small diameter operates in a flying ring mode to spin in the air, and in a larger diameter operates as a Hula-Hoop, said hoop comprising:

A. a planar annulus formed of non-stretchable, non-woven fabric sheeting of uniform thickness impermeable to air having an outer circular periphery and an inner circular periphery having a soft edge of the same thickness as the sheeting; and B. a ring formed of highly deformable spring metal concentric with the outer periphery of the annulus and joined thereto, said inner circular periphery being free whereby said ring is twistable 360 degrees to collapse the hoop into an endless coil having three intermeshing convolutions to provide a compact structure when the hoop is not in use, said annulus in the flying ring mode, when the hoop is launched by a player, functioning as an air foil, and in the Hula-Hoop mode when the hoop surrounds a player, as a protective crushable inner liner.

2. A hoop as set forth in claim 1, in which the ring is formed of a strip of spring metal which is at a right angle to the plane of the annulus.

3. A hoop as set forth in claim 2, in which the metal is steel.

4. A hoop as set forth in claim 2, in which the ring formed by the metal strip is joined to the outer periphery of the annulus by a tape wrapped about the ring and stitched to the annulus.

5. A hoop as set forth in claim 1 in which the ring is twistable 360 degrees to collapse the hoop into an endless coil having three intermeshing convolutions to provide a highly compact structure.

* * * * *